US006918347B2

(12) United States Patent
Lu et al.

(10) Patent No.: US 6,918,347 B2
(45) Date of Patent: Jul. 19, 2005

(54) VARIABLE AQUATIC FLOATING KIT FOR LEISURE AND SPORTS

(75) Inventors: Chin-Min Lu, Taipei (TW); Lai-Chung Lee, Taipei (TW); Jun-Xing Lee, Chiayi (TW)

(73) Assignee: Hi-Mark International Design Inc., Taipei (TW)

( * ) Notice: Subject to any disclaimer, the term of this patent is extended or adjusted under 35 U.S.C. 154(b) by 0 days.

(21) Appl. No.: 10/607,268

(22) Filed: Jun. 27, 2003

(65) Prior Publication Data

US 2004/0229532 A1 Nov. 18, 2004

(30) Foreign Application Priority Data

May 14, 2003 (TW) ..... 92208818

(51) Int. Cl.[7] ..... B63B 7/04
(52) U.S. Cl. ..... 114/352; 441/129; 441/130
(58) Field of Search ..... 441/129–133, 441/35; 114/343, 347, 352–354, 357

(56) References Cited

U.S. PATENT DOCUMENTS

| | | | | | |
|---|---|---|---|---|---|
| 1,761,680 | A | * | 6/1930 | Rawlings | 441/131 |
| 3,161,897 | A | * | 12/1964 | Hill | 441/130 |
| 5,197,404 | A | * | 3/1993 | Haley et al. | 114/267 |
| 5,791,958 | A | * | 8/1998 | Yeung | 441/130 |
| 6,083,067 | A | * | 7/2000 | McCredie | 441/129 |

* cited by examiner

*Primary Examiner*—Ed Swinehart
(74) *Attorney, Agent, or Firm*—Dennison, Schultz, Dougherty & MacDonald

(57) ABSTRACT

An aquatic floating kit variable in combination for leisure and sports, said floating kit comprises: a seat for seating and lying and at least an arciform floating member, the seat and the floating members are mutually detachably connected, changing in amount and in positions for combination of the floating members makes the floating kit have multiple functions used in leisure and sports as a surfing board, a floating bed for leisure, a rocking horse or a boat etc.

8 Claims, 9 Drawing Sheets

VARIABLE AQUATIC FLOATING KIT FOR LEISURE AND SPORTS

BACKGROUND OF THE INVENTION

1. Field of the Invention

The present invention is related to an aquatic floating kit variable in combination for leisure and sports, and especially to such an aquatic floating kit for leisure and sports, which kit is structurally simple, can be varied in pursuance of combinations of different modeling at will, it is suitable for use as a floating kit for leisure, swimming and sports.

2. Description of the Prior Art

In blazing summer days, places that people can immediately think of for cooling and getting the summer heat away are no other than riversides, sea shores, swimming pools etc. By virtue that many countries adopted the system of two days off a week, people think more and more highly of the activities of leisure; hence there have been instruments or equipments for aquatic activities continuously provided in the markets, such as surfboards, air-cushion life boats and floating beds etc., they can get the function of leisure and amusement no matter they are dynamic or static facilities.

However, by changing of times and elevating of consuming level, consumers are more and more catching up with the fashion, commodities of no change or with dull modeling can no more meet the requirements of the large population of consumers. Only products with multiple functions and multiple purposes meet the tendency and choice of the consumers' markets. Therefore, only those products that are multifunctional, brand new and special designed can make the user outstand others. In view of these, the inventor of the present invention had the motive of studying and developing the present invention to improve the singular usage of the existing leisure aquatic instruments in order to get multiple effects of leisure, amusement and sports.

SUMMARY OF THE INVENTION

The primary object of the present invention is to provide an aquatic floating kit variable in combination for leisure and sports, which kit is structurally simple and can be varied in pursuance of combinations of different modeling at will.

To achieve the object, the aquatic floating kit variable in combination for leisure and sports of the present invention includes a seat for seating and lying and at least an arciform floating member. In practicing, each floating member has on one side thereof a plurality of engaging holes; the seat has on the surface thereof a plurality of sleeves of which each has a plurality of engaging holes or snap locking members; at least a connecting rod has one end thereof movably engaged with a sleeve of the floating member, the other end of the connecting rod is movably engaged with an engaging hole of the floating member.

Therefore, various floating kits of different shapes and functions can be formed just by variation in the amount and positions of the floating members to make combination of the floating members with the seat.

The present invention will be apparent after reading the detailed description of the preferred embodiment thereof in reference to the accompanying drawings.

DETAILED DESCRIPTION OF THE PREFERRED EMBODIMENT

Figure 1:
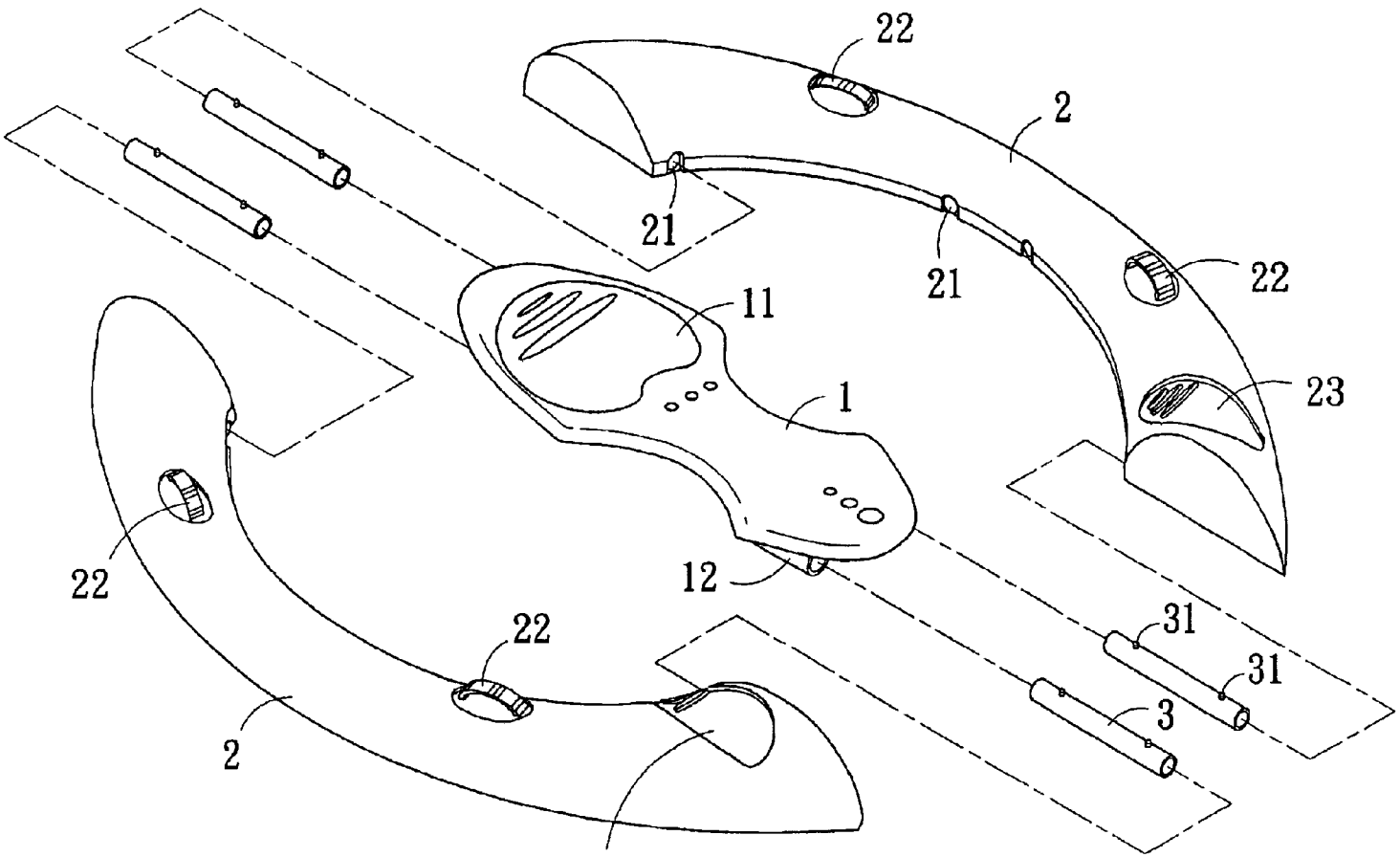
FIG. 1 is an analytic perspective view showing the elements of an embodiment of the present invention.

Referring firstly to FIG. 1 showing an embodiment of an aquatic floating kit variable in combination for leisure and sports of the present invention, the kit comprises: a seat 1, at least a floating member 2 and at least a connecting rod 3, as shown in FIGS. 1–4, the embodiment is a combination like a boat.

Wherein: the seat 1 has a contour of a letter "8", can be made of EVA foamed material; the seat 1 is provided on the top side thereof with a slide-proof seating pad 11, and on the two ends of the back side thereof with two sleeves 12 each with a plurality of engaging holes 121; each connecting rod 3 has on each of the two ends thereof a snap member 31, so that the connecting rod 3 can be detachably or movably snap engaged in the sleeves 12;

The floating members 2 are arciform, and can be made of EVA foamed material; each floating member 2 has on one side thereof a plurality of engaging holes 21 for engagement of the connecting rods 3 therein; the floating member 2 further has waterproof holding handles 22 and slide-proof members 23 for placing feet thereon;

In using, the design of the snap engagement can make the connecting rods 3, the floating members 2 and the seat 1 being mutually movably engaged to form an aquatic floating kit for leisure and sports. After use, the connecting rods 3 are detached from the floating members 2, and then can be directly slipped into the sleeves 12 of the seat 1, this can save the spaces and volumes for packaging, shipping as well as storing.

Figure 5:
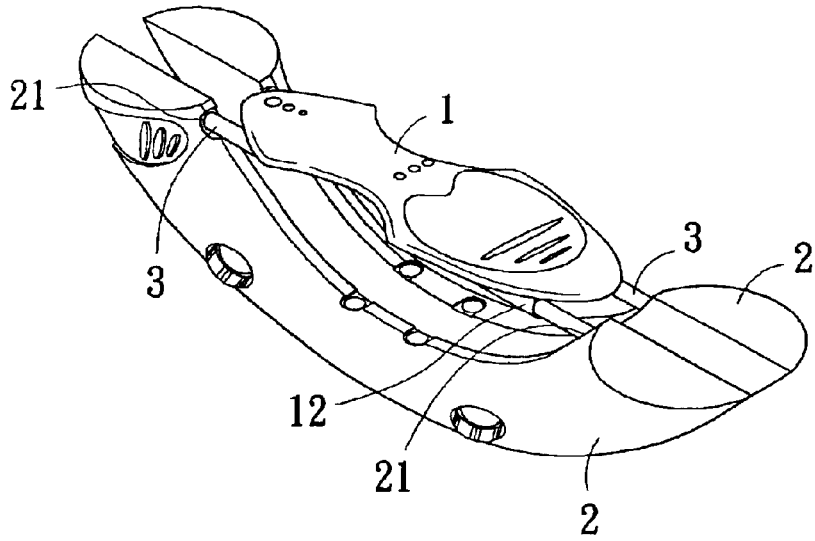
FIG. 5 is a perspective view of the present invention functioning as a rocking horse.
Figure 6:
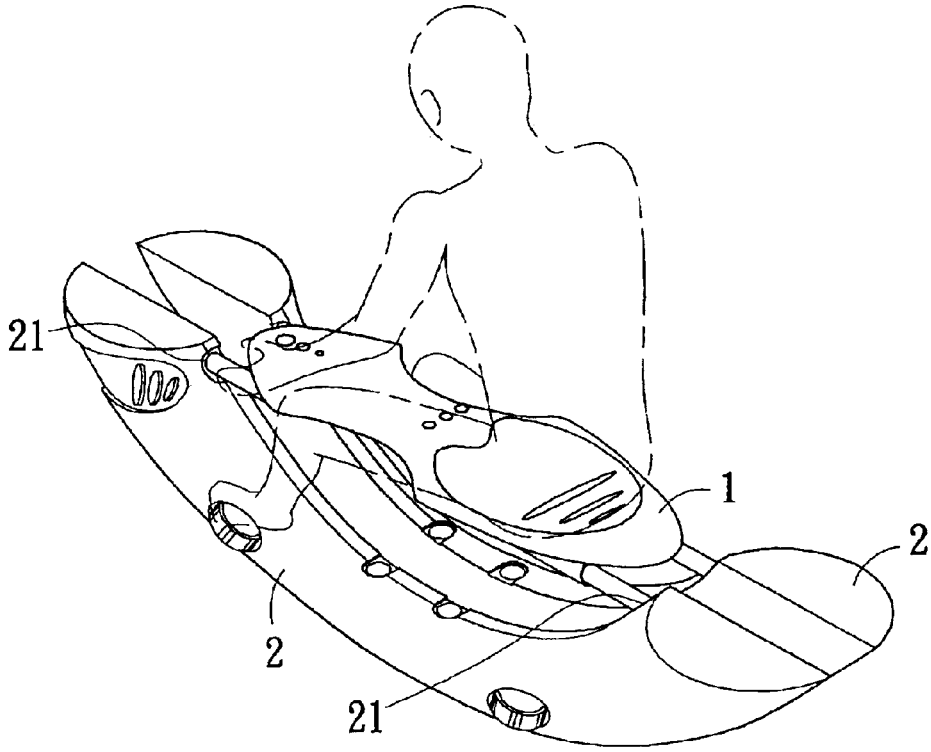
FIG. 6 is a perspective view showing use of the embodiment of FIG. 5.

The present invention can have various functions for leisure by variation of the amount and positions of the floating members, the following examples are provided for understanding of the variations of combination of the present invention:

As shown in FIGS. 5, 6, the sleeves 12 provided on the two ends of the seat 1 are respectively snap engaged with the connecting rods 3, the other end of each of the connecting rods 3 is snap engaged with an engaging hole 21 of the floating members 2, the seat 1 thereby is orthographically connected with the floating members 2 arranged in a upright mutual abutting state to form a floating kit in the shape of a bow, the floating kit can be used as a rocking horse.

Figure 2:
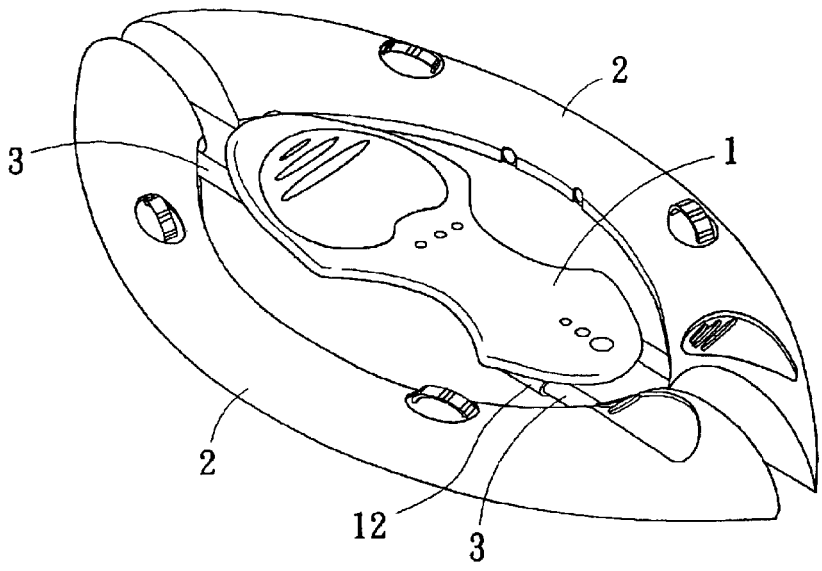
FIG. 2 is a perspective view of the embodiment of the present invention.
Figure 3:
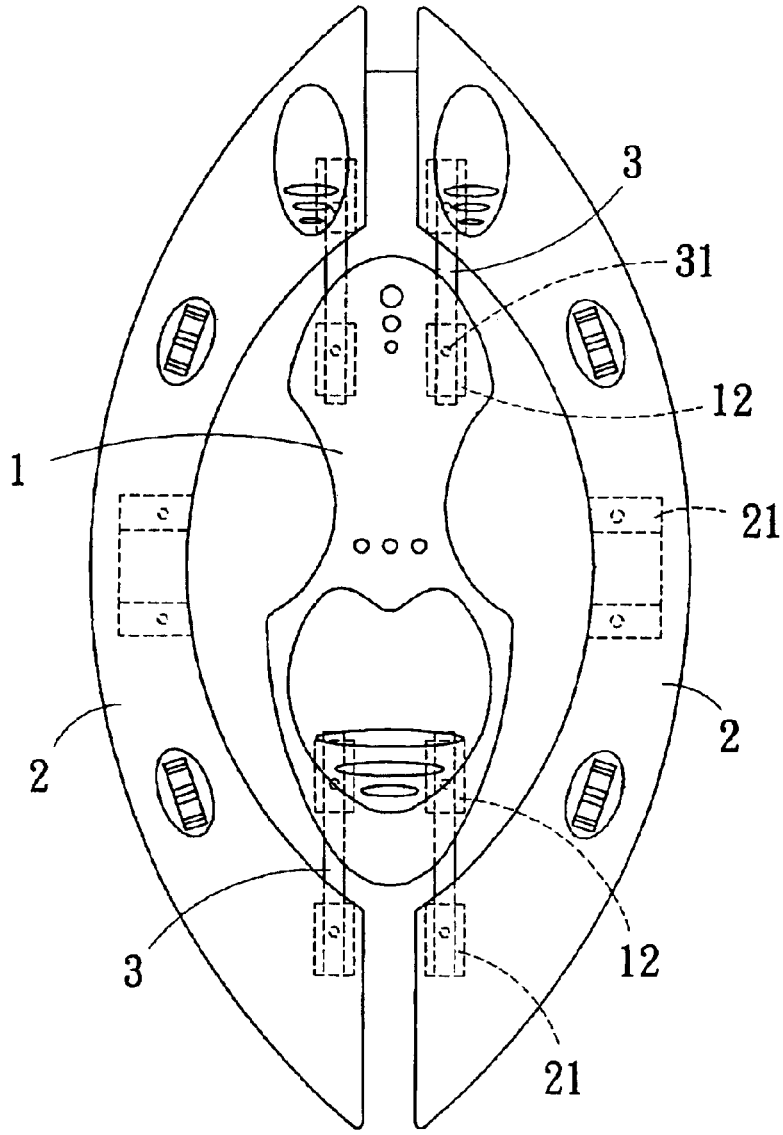
FIG. 3 is a top view taken from FIG. 2.
Figure 4:
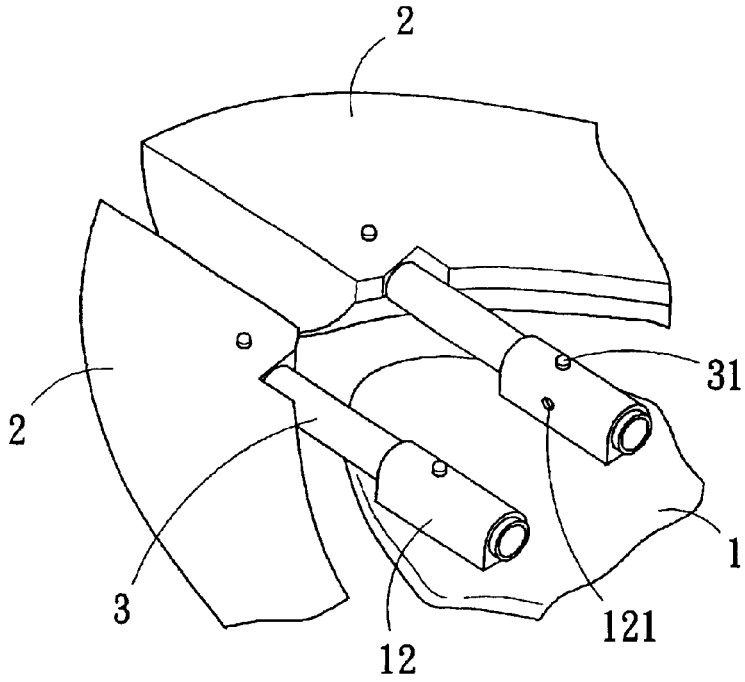
FIG. 4 is an enlarged perspective view showing a part of the embodiment of the present invention.
Figure 7:
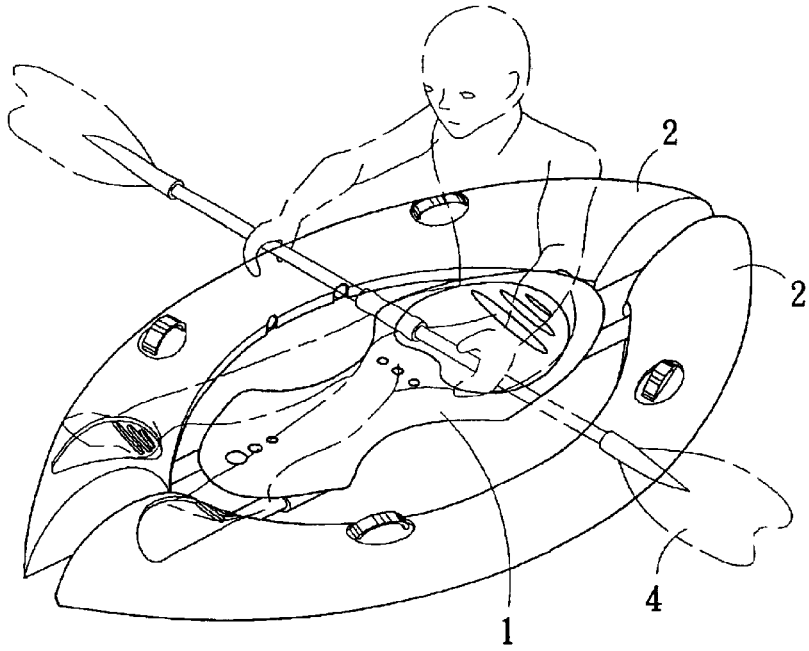
FIG. 7 is a schematic perspective view showing use of the present invention as a rowing boat.

And as shown in FIGS. 2 and 7, the sleeves 12 provided on the two ends of the seat 1 are respectively snap engaged with the connecting rods 3, the other end of each of the connecting rods 3 is snap engaged with an engaging hole 21 provided on one of the two ends of a corresponding floating member 2 (as shown in FIG. 1), so that the two sides of the seat 1 are between and respectively connected to two horizontally and symmetrically arranged floating members 2 to form a floating kit in the form of a boat, in using with a paddle 4, the boat can be used for rowing.

Figure 8:
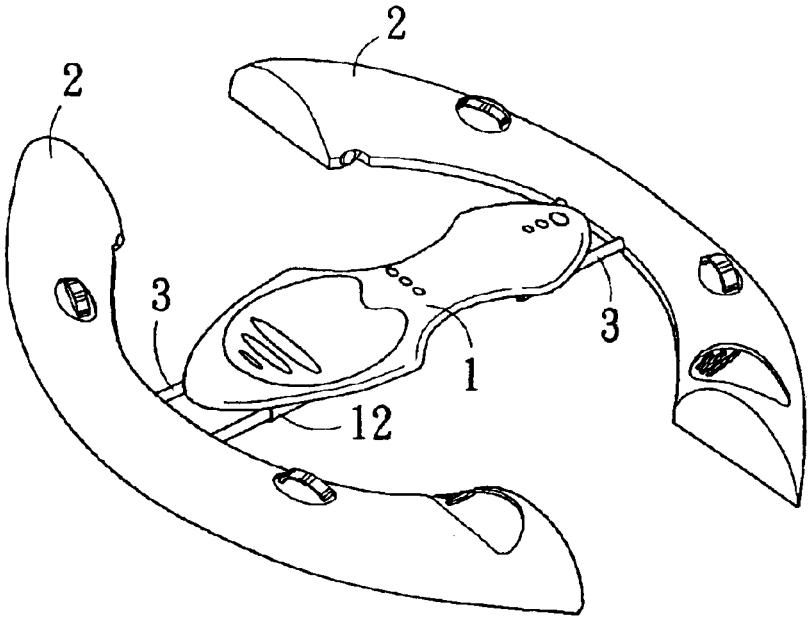
FIG. 8 is a schematic perspective view showing use of the present invention as a floating bed for leisure.
Figure 9:
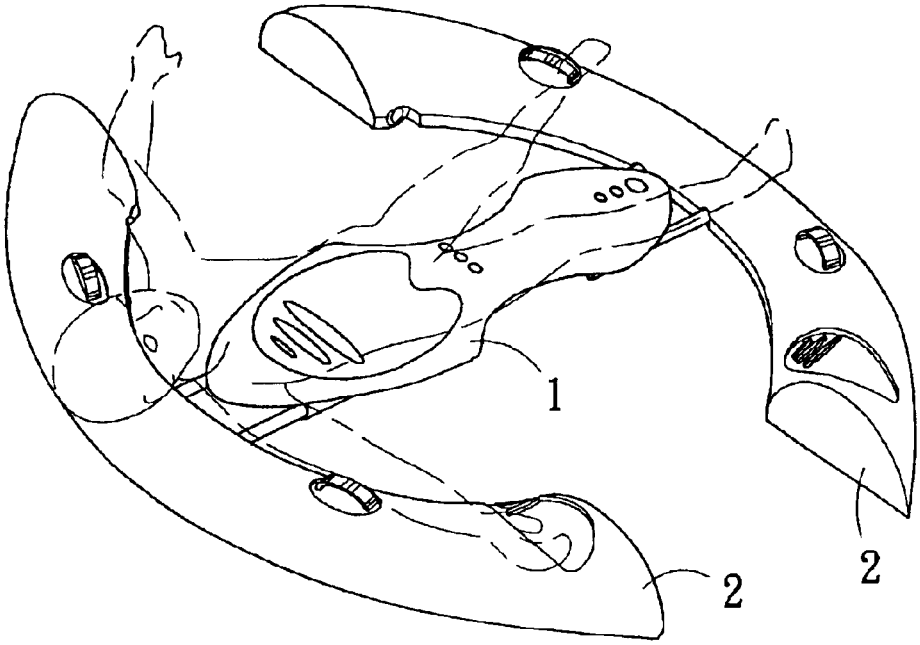
FIG. 9 is a perspective view showing use of the embodiment of FIG. 8.

And as shown in FIGS. 8, 9, the sleeves 12 (as shown in FIG. 1) provided on the two ends of the seat 1 are respectively snap engaged with the connecting rods 3, the other end of each of the connecting rods 3 is snap engaged with an engaging hole 21 in the middle of a corresponding one of the floating members 2, the two ends of the seat 1 are horizontally connected to two floating members 2 spaced a distance away from each other and horizontally and symmetrically arranged to form a floating kit in the shape of "H" to be used as a floating bed for leisure.

Figure 10:
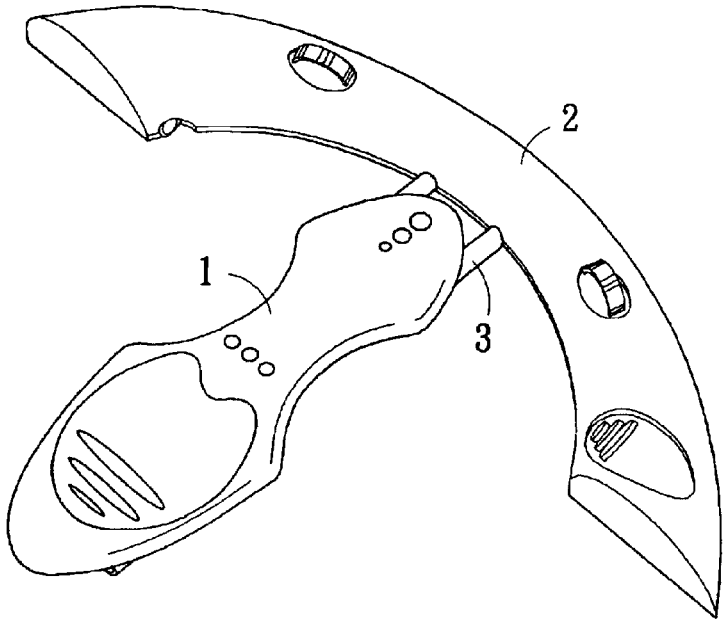
FIG. 10 is a schematic perspective view showing use of the present invention for surfing.
Figure 11:
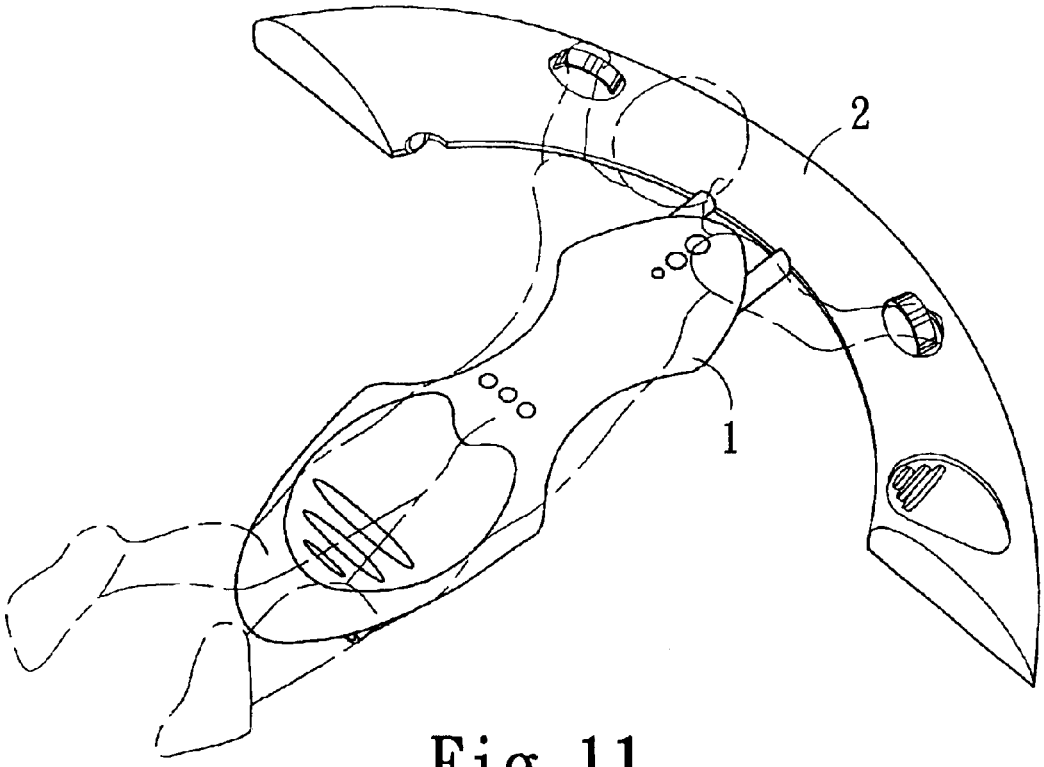
FIG. 11 is a perspective view showing use of the embodiment of FIG. 10.
Figure 12:
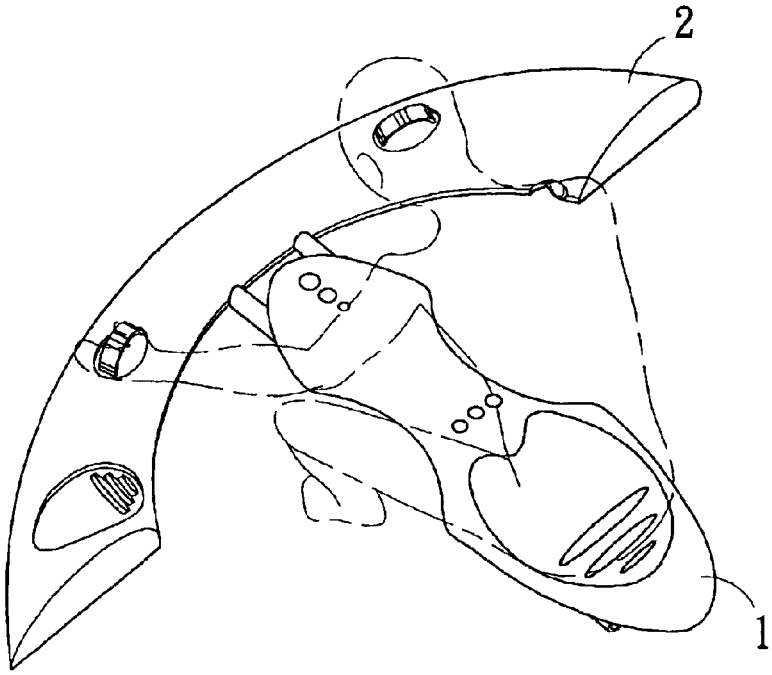
FIG. 12 is another perspective view showing use of the embodiment of FIG. 10.

Taking a floating member 2 in connecting with a seat 1 as an example, and referring to FIGS. 10–12, the sleeves 12 provided on the two ends of the seat 1 (not shown) are respectively snap engaged with the connecting rods 3, the other end of each of the connecting rods 3 is snap engaged with an engaging hole 21 (as shown in FIG. 1) in the middle of the floating member 2, so that the seat 1 is horizontally connected to the middle area of the floating member 2 to form a floating kit in the shape of "T" to be used for surfing.

Therefore, the present invention has the following advantages:

1. The seat and the floating members provided in the present invention are mutually detachably connected, so that the connecting rods can be directly slipped into the sleeves of the seat, this can make the floating kit of the present invention structurally simple, easy for assembling and convenient for carrying, and can save the spaces and volumes for packaging, shipping as well as for storing.
2. The present invention has no limitation as to the site located (such as riversides, sea shores, swimming pools), it can be varied in amount, positions and combination of the floating members, so that when the floating members are assembled with the seat, they can form a floating kit of one of various shapes with multiple functions used in leisure, swimming and sports.

The embodiment given is only for illustrating the present invention, and not for giving any limitation to the scope of the present invention. It will be apparent to those skilled in this art that various modifications or changes without departing from the spirit of this invention, such as changing in the amount of floating members, partial decorations for the floating members and the seat, changing in positions of the areas for connecting the floating members and the seat as well as changing in the connecting members for the floating members and the seat etc. shall also fall within the scope of the appended claims.

According to the above stated, the present invention can surely get its expected object to provide an aquatic floating kit variable in combination for leisure and sports which has an extremely practicable value. Having thus stated in detail.

What we claim as new and desire to be secured by Letters Patent of the United States are:

1. An aquatic floating kit variable in combination for leisure and sports, said floating kit comprises:

a seat for seating and lying and at least an arciform floating member, said seat and said floating members are mutually detachably connected, changing in amount and in positions for combination of said floating members makes said floating kit have multiple functions used in leisure and sports;

wherein said seat has a plurality of connecting members, each of said floating members has on one side thereof a plurality of connecting holes; connecting of said seat with at least one of said floating members forms said aquatic floating kit;

wherein said connecting holes on one side of each of said floating members are a plurality of engaging holes, and said connecting members of said seat are a plurality of sleeves; at least a connecting rod is provided having one end thereof movably engaged with one of said sleeves of said floating members, the other end of said connecting rod is movably engaged with one of said engaging holes of said floating members;

wherein a front end of said seat is connected to a middle area of one of said floating members to make said floating kit a shape of "T" to be used for surfing wherein said floating kit has two of said floating members arranged in an upright mutual abutting state, said seat is orthographically connected on two ends thereof with said floating members on two ends of the latter to make said floating kit a shape of a bow to be used as a rocking horse; and, wherein said floating kit has two of said floating members horizontally and mutually symmetrically arranged, a front and a rear end of said seat are horizontally connected to two ends respectively of a corresponding one of said two floating members to make said floating kit a form of a boat, to be used for rowing.

2. The aquatic floating kit variable in combination for leisure and sports as in claim 1, wherein movable engaging of said connecting rods with said floating members and said seat is done by snap engaging of a snap member with a plurality of engaging holes provided on said sleeves, said connecting rods are adapted to detachably snap receiving in said sleeves of said seat.

3. The aquatic floating kit variable in combination for leisure and sports as in claim 1, wherein said floating kit has two of said floating members horizontally and mutually symmetrically arranged, a front and a rear end of said seat are horizontally connected to a middle area respectively of a corresponding one of said two floating members to make said floating kit the shape of "H" to be used as a floating bed for leisure.

4. The aquatic floating kit variable in combination for leisure and sports as in claim 1, wherein said floating kit in said form of a boat has a paddle to be used for rowing.

5. The aquatic floating kit variable in combination for leisure and sports as in claim 1, wherein said seat is in a contour of a letter "8", and is provided on a top side thereof with a slide-proof seating pad.

6. The aquatic floating kit variable in combination for leisure and sports as in claim 1, wherein said floating members each has at least a waterproof holding handle.

7. The aquatic floating kit variable in combination for leisure and sports as in claim 1, wherein said floating members each has at least a slide-proof member for placing a foot thereon.

8. The aquatic floating kit variable in combination for leisure and sports as in claim 1, wherein said seat and said floating members are made of EVA foamed material.

* * * * *